US010337706B2

(12) United States Patent
Pierre

(10) Patent No.: US 10,337,706 B2
(45) Date of Patent: Jul. 2, 2019

(54) MOUNTING SYSTEM

(71) Applicant: Life Mounts, LLC, Goleta, CA (US)

(72) Inventor: Christoph Roger Pierre, Santa Barbara, CA (US)

(73) Assignee: Life Mounts, LLC, Goleta, CA (US)

( * ) Notice: Subject to any disclaimer, the term of this patent is extended or adjusted under 35 U.S.C. 154(b) by 0 days.

(21) Appl. No.: 15/942,057

(22) Filed: Mar. 30, 2018

(65) Prior Publication Data

US 2018/0224098 A1 Aug. 9, 2018

Related U.S. Application Data

(63) Continuation-in-part of application No. 15/083,593, filed on Mar. 29, 2016, now Pat. No. 9,939,138.

(60) Provisional application No. 62/175,366, filed on Jun. 14, 2015, provisional application No. 62/153,129, filed on Apr. 27, 2015.

(51) Int. Cl.
*F21V 21/14* (2006.01)

(52) U.S. Cl.
CPC ..... *F21V 21/145* (2013.01)

(58) Field of Classification Search
CPC ..... F21V 21/0816; F21V 21/145; F16B 1/00
USPC ..... 362/418
See application file for complete search history.

*Primary Examiner* — Toan C Ly
(74) *Attorney, Agent, or Firm* — Alleman Hall Creasman & Tuttle LLP

(57) ABSTRACT

A mounting system comprises an elastomeric mount portion including: a barrel having a first bore formed therein and a rim at a first end of the barrel that forms a first interface surface, and a pair of mounting arms that project outward from a second end of the barrel that collectively form an arc that defines a curved mounting surface for mounting a first object. A channel is formed in the pair of mounting arms or the barrel that passes through the elastomeric mount portion. The mounting system further includes a fastener for securing the elastomeric mount portion to a second object. The fastener includes a shaft that passes through the first bore along the longitudinal axis and projects outward from the first interface surface of the barrel. The mounting system further includes a strap that passes through the channel to secure the first object to the curved mounting surface.

20 Claims, 10 Drawing Sheets

MOUNTING SYSTEM

CROSS-REFERENCE TO RELATED APPLICATIONS

The present application is a non-provisional application of and claims priority to U.S. patent application Ser. No. 15/083,593, titled "Flashlight Mount", filed Mar. 29, 2016, which is a non-provisional application of and claims priority to U.S. provisional patent application No. 62/175,366, titled "A flashlight mount, and a method for mounting a flashlight, to a backpack shoulder strap", filed Jun. 14, 2015 and U.S. provisional patent application No. 62/153,129, titled "A flashlight mount, and a method for mounting a flashlight, to any rounded structure", filed Apr. 27, 2015, the entire contents of each of these priority applications are incorporated herein by reference in their entirety for all purposes.

BACKGROUND

Hand operated flashlights are used in a variety of contexts as a source of artificial light. A challenge for many flashlight users is the ability to hold and direct the flashlight while also retaining use of their hands for other tasks. Often, flashlight users will hold flashlights in their mouth, balance the flashlight on or against another object, or request assistance from another person in order to free up one of their hands.

SUMMARY

A flashlight mounting system disclosed herein includes a first elastomeric mount portion, a second elastomeric mount portion, and a fastener having a shaft that secures the first and second elastomeric mount portions to each other. The first and second elastomeric mount portions are able to rotate relative to each other about the shaft. The flashlight mounting system further includes a first strap that passes through the first elastomeric mount portion to secure the first elastomeric mount portion to a flashlight (or other suitable object), and a second strap that passes through the second elastomeric mount portion to secure the second elastomeric mount portion to a support structure.

In an example, each elastomeric mount portion includes a barrel having a rim that forms an interface surface at a distal end of the barrel. The first interface surface may have a set of teeth that are continuous along the rim of the barrel, and that interface with corresponding teeth on the other elastomeric mount portion. Each elastomeric mount portion further includes a pair of mounting arms that project outward from an opposite end of the first barrel. The mounting arms collectively form a tapering arc that defines a curved mounting surface along an interior of the tapering arc. Each mounting arm forms an arc segment of the tapering arc that tapers from a base of that mounting arm that joins with the barrel to a distal end of that mounting arm.

A mounting system is also disclosed herein that comprises an elastomeric mount portion including: a barrel having a first bore formed therein and a rim at a first end of the barrel that forms a first interface surface, and a pair of mounting arms that project outward from a second end of the barrel that collectively form an arc that defines a curved mounting surface for mounting a first object. A channel is formed in the pair of mounting arms or the barrel that passes through the elastomeric mount portion. The mounting system further includes a fastener for securing the elastomeric mount portion to a second object. The fastener includes a shaft that passes through the first bore along the longitudinal axis and projects outward from the first interface surface of the barrel. The mounting system further includes a strap that passes through the channel to secure the first object to the curved mounting surface.

This summary provides only a sample of the subject matter described in further detail by the detailed description and associated drawings. Accordingly, claimed subject matter is not limited by this summary.

DETAILED DESCRIPTION

A flashlight mounting system disclosed herein includes a first elastomeric mount portion, a second elastomeric mount portion, and a fastener having a shaft that secures the first and second elastomeric mount portions to each other. The first and second elastomeric mount portions are able to rotate relative to each other about the shaft. The flashlight mounting system further includes a first strap that passes through the first elastomeric mount portion to secure the first elastomeric mount portion to a flashlight (or other suitable object), and a second strap that passes through the second elastomeric mount portion to secure the second elastomeric mount portion to a support structure.

Figure 1:
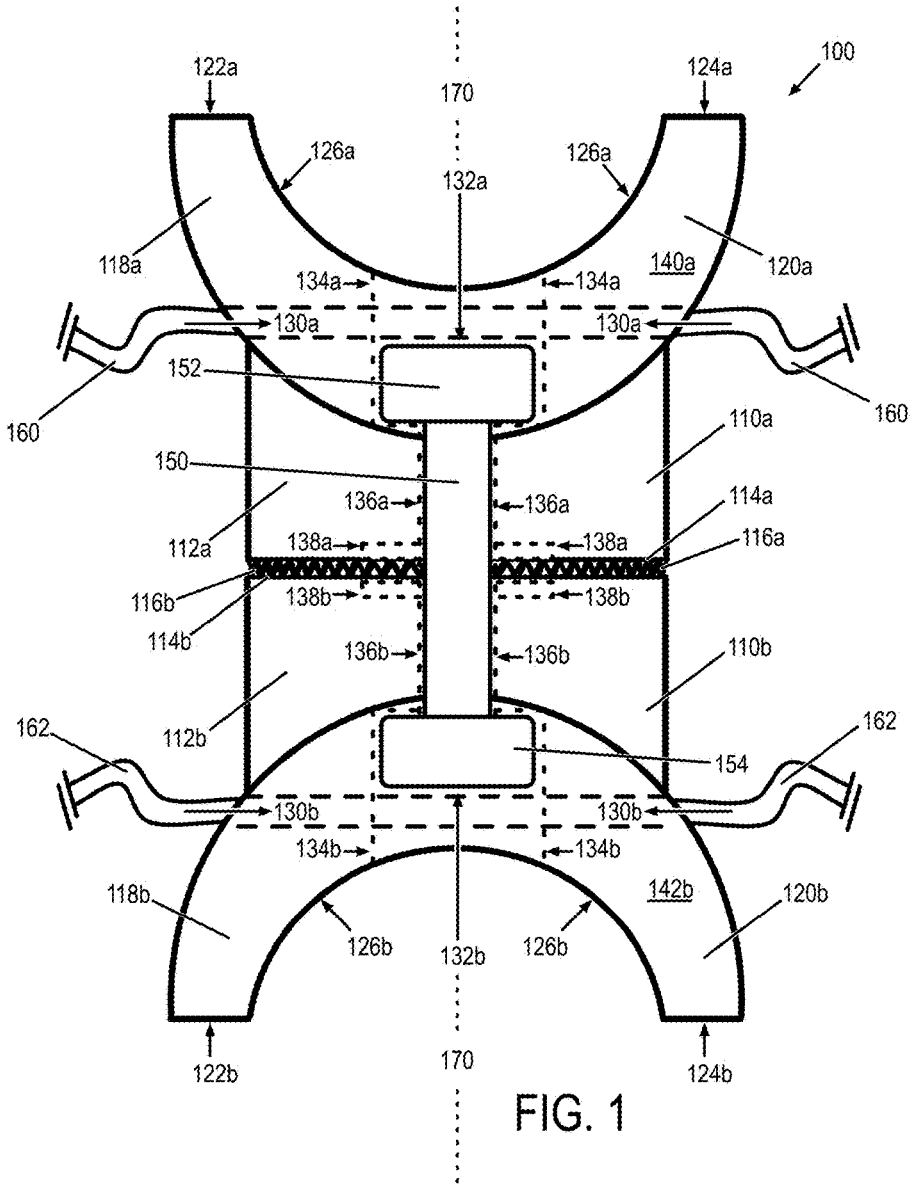
FIG. 1 depicts an example flashlight mounting system.

FIG. 1 depicts an example flashlight mounting system 100. Flashlight mounting system 100 includes a first elastomeric mount portion 110*a* and a second elastomeric mount portion 110*b* that are secured to each other or otherwise joined by a shaft 150. First elastomeric mount portion 110*a* and second elastomeric mount portion 110*b* are able to rotate relative to each other about shaft 150. An axis of rotation 170 of first elastomeric mount portion 110*a* and a second elastomeric mount portion 110*b* is depicted in FIG. 1 as passing through a longitudinal axis of shaft 150. Rotation of first elastomeric mount portion 110*a* relative to second elastomeric mount portion 110*b* about axis of rotation 170 enables a user to adjust an orientation of objects retained by or otherwise secured to the mount portions.

In this example, first elastomeric mount portion 110*a* is identical or substantially identical to second elastomeric mount portion 110*b*. In other examples, first elastomeric mount portion 110*a* and second elastomeric mount portion 110*b* may have different physical configurations relative to each other. However, an advantage of first elastomeric mount portion 110*a* and second elastomeric mount portion 110*b* being identical or substantially identical to each other enables these parts to be formed from the same mold and/or manufacturing process, thereby reducing the cost and complexity of manufacturing and assembling the flashlight mounting system.

First elastomeric mount portion 110*a* includes a first barrel 112*a* having a rim that forms a first interface surface 114*a* at a distal end of the first barrel. First interface surface 114*a* has a first set of teeth 116*a* that are continuous along the rim of the first barrel. Second elastomeric mount portion 110*b* includes a second barrel 112*b* having a rim that forms a second interface surface 114*b* at a distal end of the second barrel. Second interface surface 114*b* has a second set of teeth 116*b* that are continuous along the rim of the second barrel.

First interface surface 114*a* and second interface surface 114*b* interface with each other in which first set of teeth 116*a* interface and engage with second set of teeth 116*b* to resist rotation of first elastomeric mount portion 110*a* relative to second elastomeric mount portion 110*b* about shaft 150 and axis of rotation 170. A user may overcome this resistance to rotation provided by elastomeric features of portions 110*a* and 110*b*, including teeth 116*a* and 116*b*, by twisting first elastomeric mount portion 110*a* relative to second elastomeric mount portion 110*b* using a hand-applied twisting force. This twisting force is sufficient to cause deformation of teeth 116*a* and 116*b* to allow the teeth of opposing mount portions to pass over or past each other, thereby permitting rotation of first mount portion 110*a* relative to second mount portion 110*b*. Additionally or alternatively, a user may draw first elastomeric mount portion 110*a* away from second elastomeric mount portion 110*b* against a compression force provided by shaft 150 through deformation of these elements to partially disengage and thereby reduce the resistance to rotation provided by teeth 116*a* and 116*b*.

As a non-limiting example, the twisting force needed to overcome the resistance to rotation provided by the engaged teeth without drawing apart the elastomeric mount portions may be designed to be equal to or less than commonly available food jars, while also being sufficient to maintain a flashlight in any orientation. In another non-limiting example, the twisting force needed to overcome resistance to rotation provided by the engaged teeth without drawing apart the elastomeric mount portions may be designed to be greater than a reasonable hand-applied twisting force, but may be reduced by a user to a reasonable hand-applied twisting force by drawing the elastomeric mount portions apart from each other in combination with application of the twisting force.

First elastomeric mount portion 110*a* further includes a first pair of mounting arms 118*a* and 120*a* that project outward from an opposite end of the first barrel. Mounting arms 118*a* and 120*a* collectively form a first tapering arc that defines a first curved mounting surface 126*a* along an interior of the first tapering arc. A profile of this first tapering arc is depicted in FIG. 1 along with a side surface 140*a*. Each mounting arm of mounting arms 118*a* and 120*a* forms an arc segment of this first tapering arc that tapers from a base of the mounting arm that joins with the first barrel to a distal end of the mounting arm. The distal ends of mounting arms 118*a* and 120*a* terminate at surfaces 122*a* and 124*a*, respectively.

Second elastomeric mount portion 110*b* further includes a second pair of mounting arms 118*b* and 120*b* that project outward from an opposite end of the second barrel. Mounting arms 118*b* and 120*b* collectively form a second tapering arc that defines a second curved mounting surface 126*b* along an interior of the second tapering arc. A profile of this second tapering arc is depicted in FIG. 1 along with a side surface 142*b*. Each of mounting arms 118*b* and 120*b* forms an arc segment of the second tapering arc that tapers from a base of the mounting arm that joins with the second barrel to a distal end of the mounting arm. The distal ends of mounting arms 118*b* and 120*b* terminate at surfaces 122*b* and 124*b*, respectively.

A first channel 130*a* is formed in the first pair of mounting arms 118*a* and 120*a*. First channel 130*a* passes through each of mounting arms 118*a* and 120*a*. In another example, first channel 130*a* may pass through barrel 112*a*. A first strap 160 passes through first channel 130*a* of first elastomeric mount portion 110*a*. A second channel 130*b* is formed in the second pair of mounting arms 118*b* and 120*b*. Second channel 130*b* passes through each of mounting arms 118*b* and 120*b*. In another example, second channel 130*b* may pass through second barrel 112*b*. A second strap 162 passes through second channel 130*b* of second elastomeric mount portion 110*b*.

Figure 10:
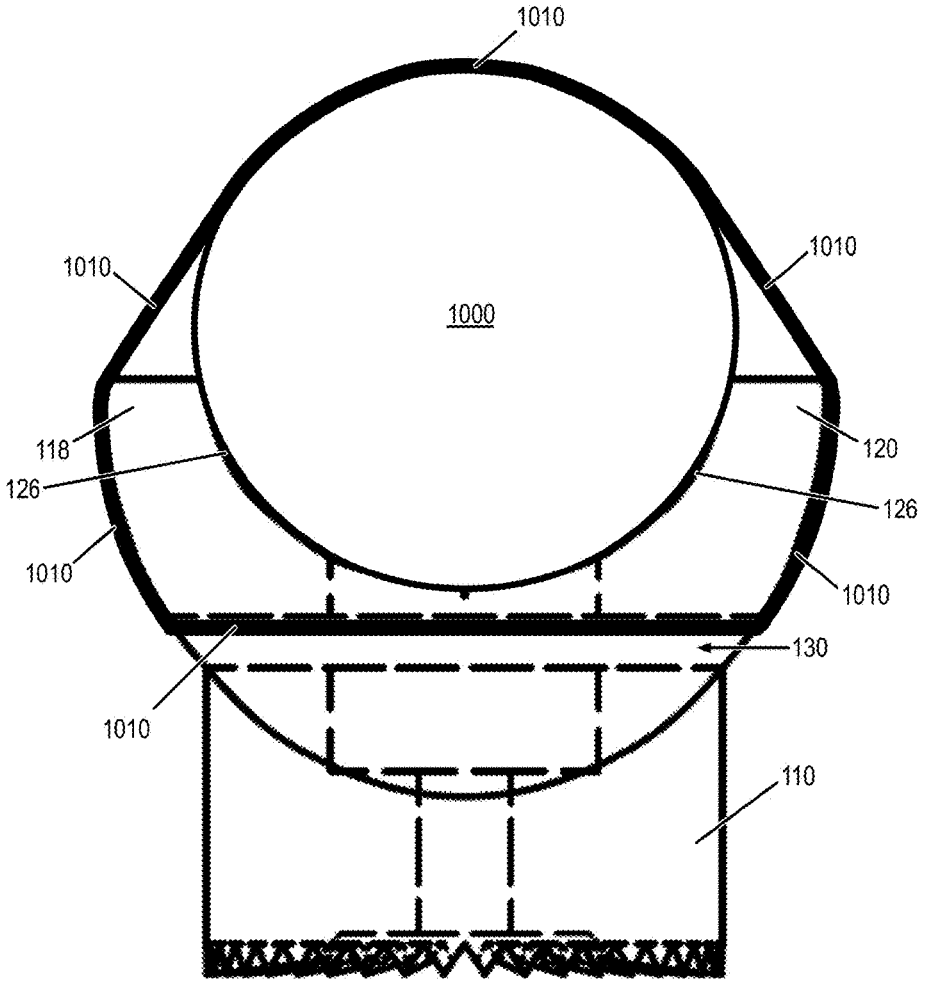
FIG. 10 depicts an example use-environment for the elastomeric mount portion of FIGS. 2-7.

A body of a flashlight (typically a cylindrical or curved body) may interface with one of curved mounting surfaces 126*a* or 126*b* of elastomeric mount portions 110*a* or 110*b*, and then be secured in place by one of straps 160 or 162. A mounting structure such as a round or cylindrical pole, beam, shaft, arm, or other structural element may interface with another one of curved mounting surfaces 126*a* or 126*b* of elastomeric mount portions 110*a* or 110*b*, and then be secured in place by another of straps 160 or 162. Once a flashlight has been secured to a mounting structure by flashlight mounting system 100, an orientation of the flashlight relative to the mounting structure may be changed by rotating elastomeric mount portion 110*a* relative to elastomeric mount portion 110*b* about shaft 150 and the axis of rotation 170. A non-limiting example of an object 1000 being secured to a mounting surface 126 by a strap 1010 is depicted in FIG. 10, in which mount portion 110 refers to either of mount portions 110*a* or 110*b*, and strap 1010 may refer to either of straps 160 or 162.

In an example, straps 160 and 162 may each include a buckle frame located at a first end of the strap through which an opposite end of the strap may be passed to form a loop. Each strap may have a hook and loop fastener (e.g., Velcro) located on a first side of the strap with either one of the loop or hook elements being located at or along an end region of the strap opposite the buckle frame, and the other of the loop or hook elements being located at or along an intermediate region of the strap. The hook and loop fastener may be secured upon itself once the end of the strap opposite the buckle frame is passed through the buckle frame to form a loop that secures the elastomeric mount portion to either a flashlight or to a suitable mounting structure. As another example, the strap may have a buckle or clasp located at a first end with holes located along an intermediate region of the strap to accommodate a prong of the buckle or clasp. As yet another example, the strap may have releasable clips located at each end, with at least one of the clips having a buckle frame that enables a length of the strap that forms a loop to be shortened or lengthened. As yet another example, a strap may include hook and loop fasteners (e.g., Velcro) without inclusion of a buckle frame or clip. Other suitable straps or strap securing techniques may be used to secure an elastomeric mount portion to a flashlight or mounting structure.

Shaft 150 may take the form of a non-elastomeric shaft. As an example, shaft 150 may be formed from a metal such as steel or aluminum, or a hard plastic. Shaft 150 secures first elastomeric mount portion 110*a* to second elastomeric mount portion 110*b*. When secured by shaft 150, first interface surface 114*a* may be compressed onto second interface surface 114*b*, which may include at least some deformation of first elastomeric mount portion 110*a* and second elastomeric mount portion 110*b*. In other examples, shaft 150 may maintain first interface surface 114*a* in contact with second interface surface 114*b* without compressing first mount portion 110*a* onto second mount portion 110*b* and/or without causing deformation of the first or second mount portions. Shaft 150 passes through at least a portion of first barrel 112*a* and at least a portion of second barrel 112*b* along a longitudinal axis of both the first barrel and the second barrel. As an example, first elastomeric mount portion 110*a* may have a first bore 132*a* defined therein, and second elastomeric mount portion 110*b* may have a second bore 132*b* defined therein through which shaft 150 passes. Here, axis of rotation 170 corresponds to the longitudinal axis of barrels 112*a* and 112*b* and their respective bores 132*a* and 132*b*.

In this example, first bore 132*a* includes a first bore segment 134*a*, a second bore segment 136*a*, and a third bore segment 138*a*. Second bore segment 136*a* is narrower than first and third bore segments 132*a* and 136*a*, in this example. A first flanged portion 152 located at a first end of shaft 150 interfaces with a widening transition between first bore segment 134*a* and second bore segment 136*a* to resist or preclude removal of shaft 150 from first bore 132*a* in a direction of the first interface surface 114*a*. Also in this example, second bore 132*b* includes a first bore segment 134*b*, a second bore segment 136*b*, and a third bore segment 138*b*. Second bore segment 136*b* is narrower than first and third bore segments 132*b* and 136*b*, in this example. A second flanged portion 154 located at a second end of shaft 150 interfaces with a widening transition between first bore segment 134*b* and second bore segment 136*b* to resist or preclude removal of shaft 150 from second bore 132*b* in a direction of the second interface surface 114*b*.

Shaft 150 in combination with flanged portions 152 and 154 may be referred to collectively as a fastener or a fastening system. This fastener or fastening system enables rotation of first mount portion 110*a* relative to second mount portion 110*b*, while also securing and/or compressing first mount portion 110*a* and second mount portion 110*b* towards each other. As a non-limiting example, shaft 150 may take the form of a cylindrical shaft of a tubular rivet, first flanged portion 152 may refer to one of a head or a tail of the rivet, and second flanged portion 154 may refer to the other one of the head or the tail of the rivet. In at least some examples, a washer may be disposed between an interfacing surface of the tail of the rivet and a surface formed by a widening transition between bore segments 134*a*/136*a* or between bore segments 134*b*/136*b* depending on the orientation of the rivet. Additionally or alternatively, in at least some examples, a washer may be disposed between an interfacing surface of the head of the rivet and a surface formed by a widening transition between bore segments 134*a*/136*a* or between bore segments 134*b*/136*b* depending on the orientation of the rivet. Other suitable fasteners or fastening systems may be used to join and secure first elastomeric mount portion 110*a* and second elastomeric mount portion 110*b*.

FIGS. 2-7 depict features of an example elastomeric mount portion 110 in further detail. Elastomeric mount portion 110 refers to any of previously described first and second elastomeric mount portions 110*a* and 110*b*. Accordingly, within FIGS. 2-7, the "a" and "b" designations have been omitted from the reference numerals.

Figure 2:
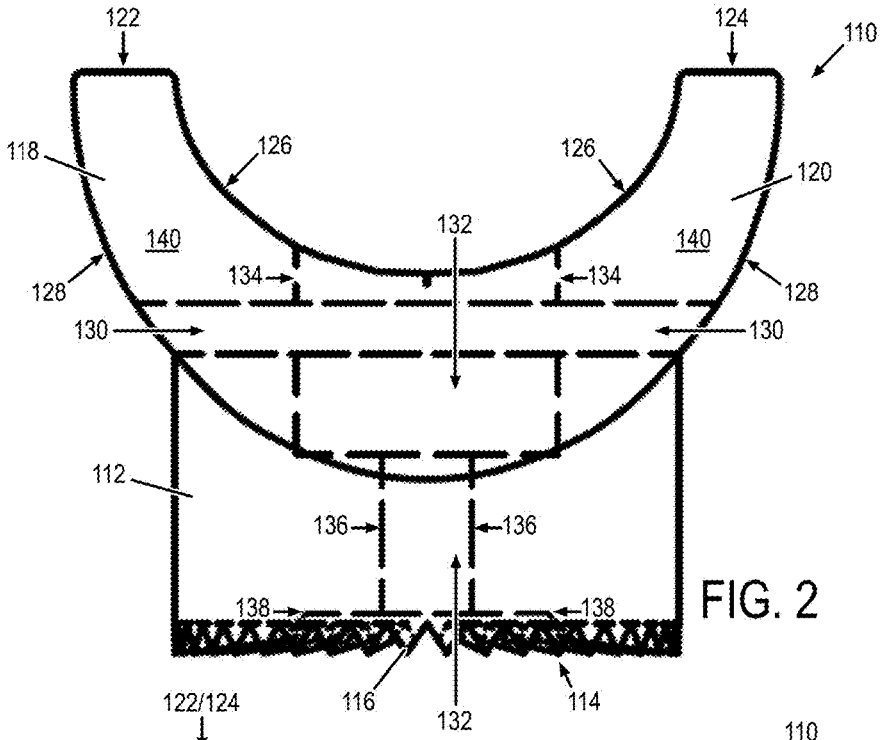
FIGS. 2-7 depict an example elastomeric mount portion.
Figure 3:
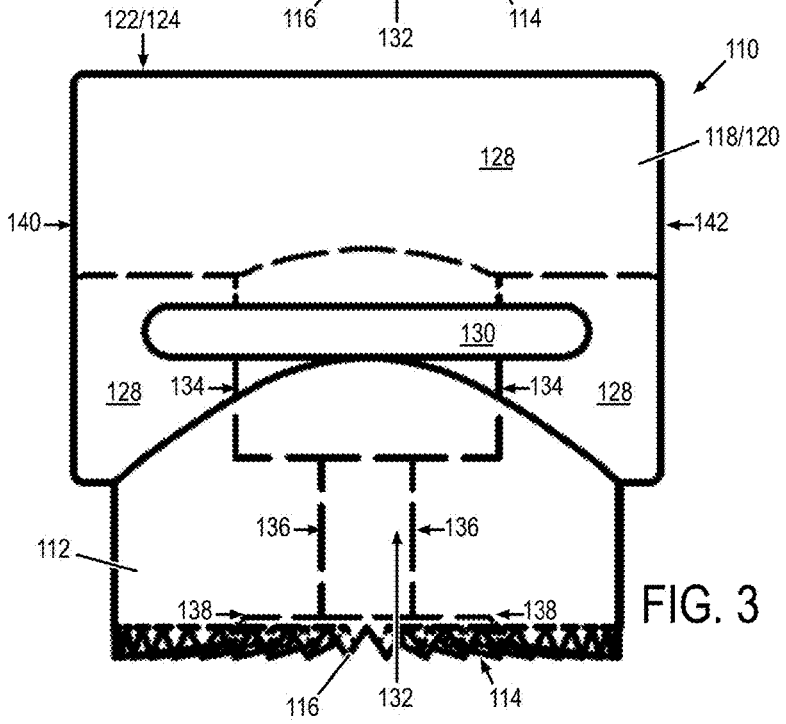

FIG. 2 depicts elastomeric mount portion 110 in the same or similar orientation (e.g., side orientation) as depicted in FIG. 1 with reference to first and second elastomeric mount portions 110*a* and 110*b*. FIG. 3 depicts elastomeric mount portion 110 rotated 90 degrees about a vertical axis, which corresponds to axis of rotation 170 in FIG. 1. Additional surfaces of mounting arms 118 and 120 are further identified in FIGS. 2 and 3 by reference numerals 128, 140, and 142. Within FIG. 3, an example profile of channel 130 is depicted as having an elongated oval, however, channel 130 may have a rectangular shape in other examples. These shapes for channel 130 may accommodate a strap or belt having a substantially flat shape when viewed in section.

Figure 4:
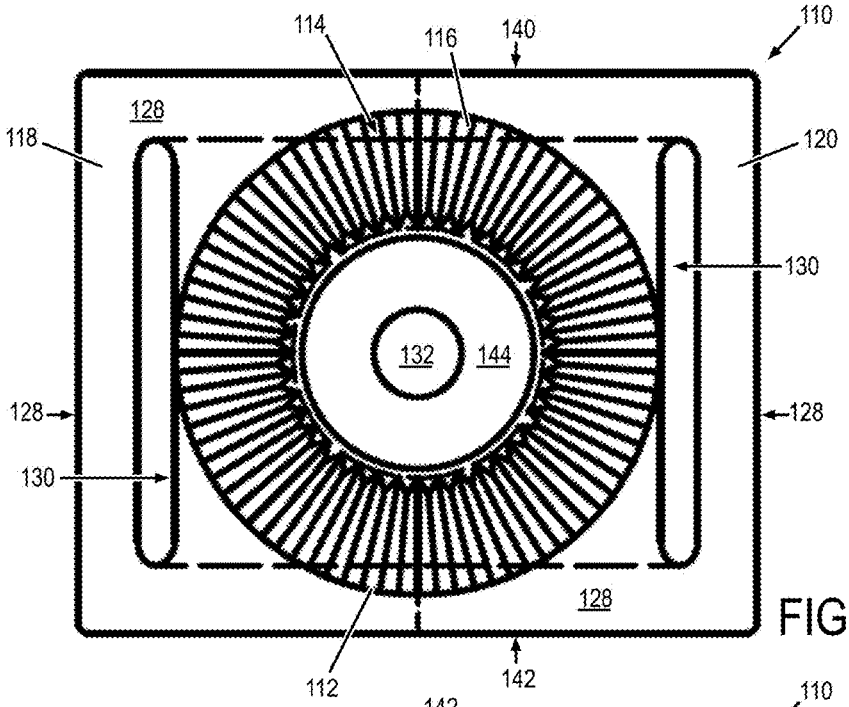
Figure 5:
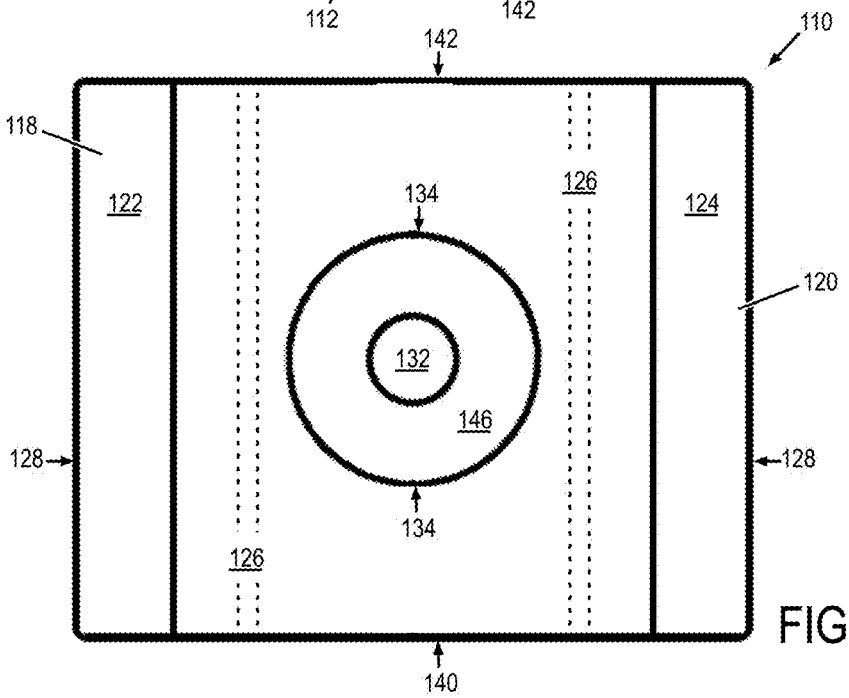

FIGS. 4 and 5 depict elastomeric mount portion 110 at orientations in which the elastomeric mount portion is being viewed along axis of rotation 170 in FIG. 1. FIG. 4 depicts an interface surface 114 side of elastomeric mount portion 110. FIG. 5 depicts an opposite side of elastomeric mount portion 110 to provide a view of curved mounting surface 126. Surfaces 122 and 124 located at the distal ends of mounting arms 118 and 120 are also depicted in FIG. 5. FIGS. 4 and 5 further depict aspects of bore 132, including surface 144 forming a widening transition between bore segments 138 and 136, and surface 146 forming a widening transition between bore segments 134 and 136. As previously described, a flanged portion located at an end of shaft 150 or washer interfacing with that flanged portion may interface with surface 146 that forms a widening transition between bore segments 134 and 136. Referring also to FIG. 1, surface 146 formed at a widening transition between bore segments 134 (134*a/b*) and 136 (136*a/b*) is located between channel 130 (130*a/b*) and interfacing surface 114 (114*a/b*) as measured along axis of rotation 170.

Figure 6:
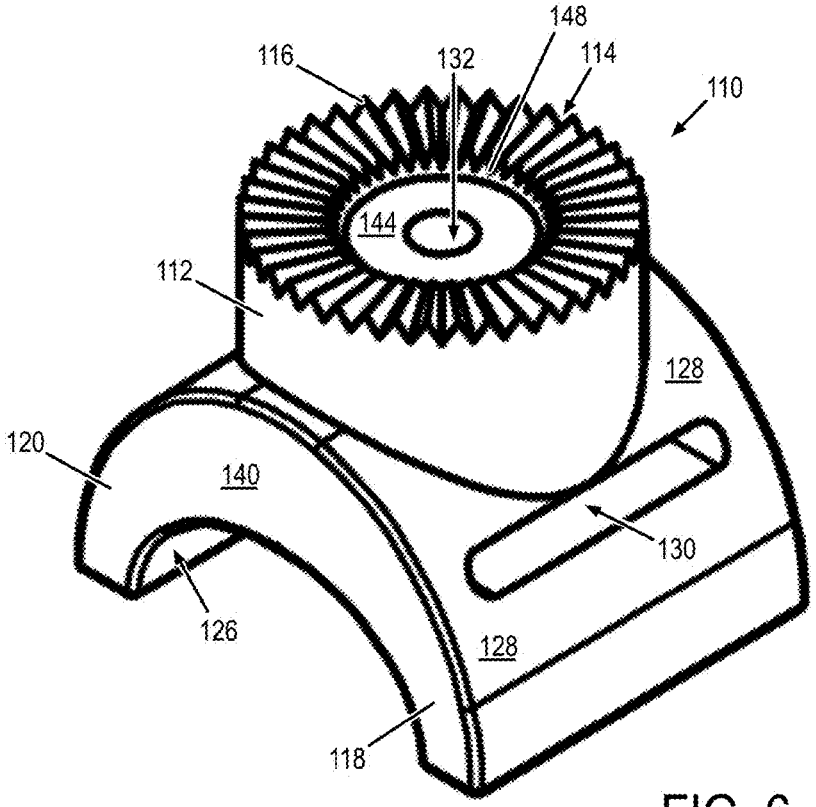
Figure 7:
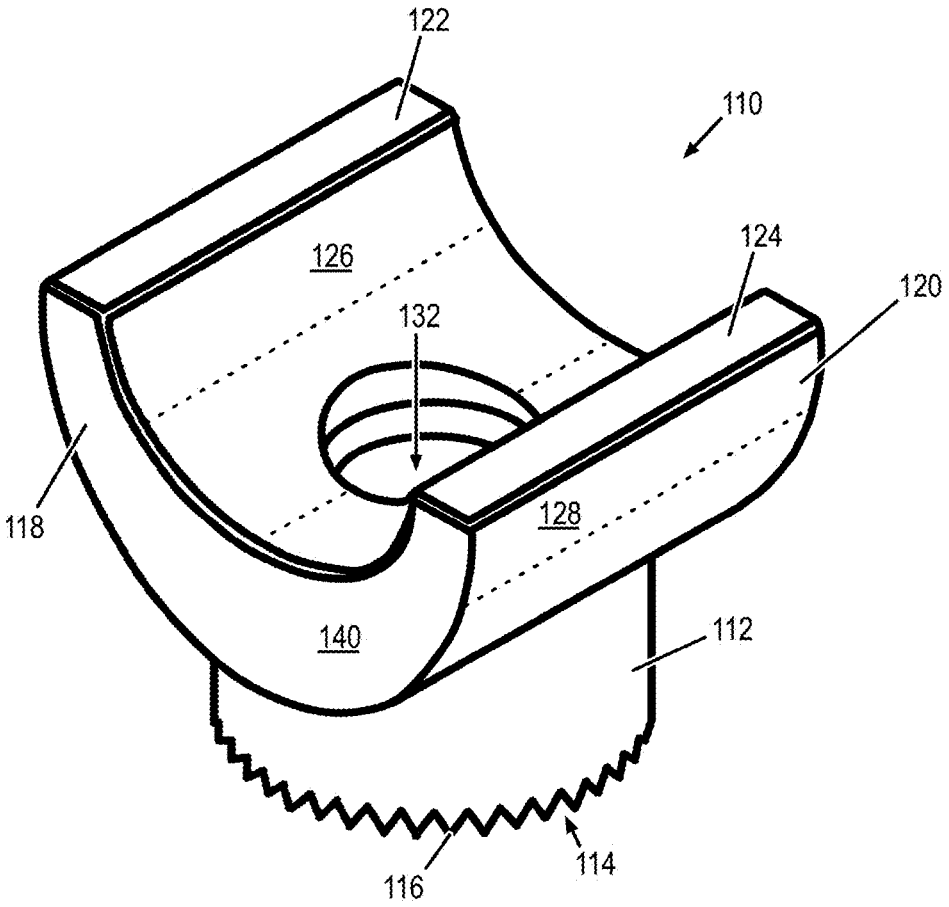

FIGS. 6 and 7 provide isometric views of elastomeric mount portion 110. FIG. 6 provides a detailed view of interface surface 114 and teeth 116. Within FIG. 6, an annular chamfer 148 forms a transition from teeth 116 to surface 144. Chamfer 148 and/or a recessed region formed by bore segment 138 may provide for easier rotation and/or a more consistent resistance to rotation about the axis of rotation 170 due to a reduction in surface area that contacts another opposing elastomeric mount portion. Additionally or alternatively, this chamfer may be applied to an inner annular edge of teeth 114 to provide better meshing or mating with an opposing set of teeth, thereby providing easier rotation and/or a more consistent resistance to rotation about the axis of rotation 170.

Each elastomeric mount portion may be formed from a unitary (i.e., single) piece of elastomeric material. At least some of the advantages of using a unitary piece of elastomeric material to form the elastomeric mount portion include cost reduction, ease of manufacture, and ease of assembly. For example, a single mold or separate instances of the same mold may be used to create each elastomeric mount portion. The flashlight mounting system may be assembled by combining two instances of the elastomeric mount portion.

Forming the mount portion from an elastomeric material may also provide a number of advantages. First, the mounting arms of the elastomeric mount portion formed from an elastomeric material are able to deform to accommodate a flashlight or mounting structure having a variety of different sizes and shapes. This deformation may provide a compression force on the flashlight or mounting structure when used in combination with a strap. In at least some use scenarios, the tapering of a width of the mounting arms and/or the arc shape of the mounting arms in combination with the elastomeric material may provide a suitable compression force profile along an interface between the curved mounting surface 126 and the flashlight or mounting structure. Second, the elastomeric material of the mounting arms provides increased friction and/or gripping force (e.g., along the curved mounting surfaces) on the flashlight or mounting structure as compared to other materials. Third, the barrel of the elastomeric mount portion being also formed from an elastomeric material enables the barrel to deform under a compression force applied via shaft 150 along the axis of rotation 170, thereby enabling the flashlight mounting system to maintain its rotational orientation under typical flashlight loads while also enabling a user to overcome at least some of this compression force to selectively adjust the orientation of the flashlight.

Providing a suitable user experience with regards to adjustability of the orientation of the flashlight mounting system and holding capability for a flashlight across a range of orientations may rely on balancing the compression force provided by the fastener or fastening system with the size and shape of the teeth and with the material properties (e.g., modulus of elasticity of the elastomeric material). As an example, teeth 116 may have a tooth depth of approximately 1.50 mm (within a range of +/−10% or 20%) and a tooth spacing of approximately 1.96 mm (within a range of +/−10% or 20%) along the rim of barrel 112 having a circular outer diameter of 25 mm (or within a range between 22 mm and 29 mm). In this example, an inner diameter of bore 138 may be approximately 12 mm (within a range of +/−10% or 20%). It will be understood that these dimensions are provided for illustrative purposes and to provide relative proportions of a specific implementation. Accordingly, these dimensions are non-limiting with respect to the features and configurations described herein.

Figure 8:
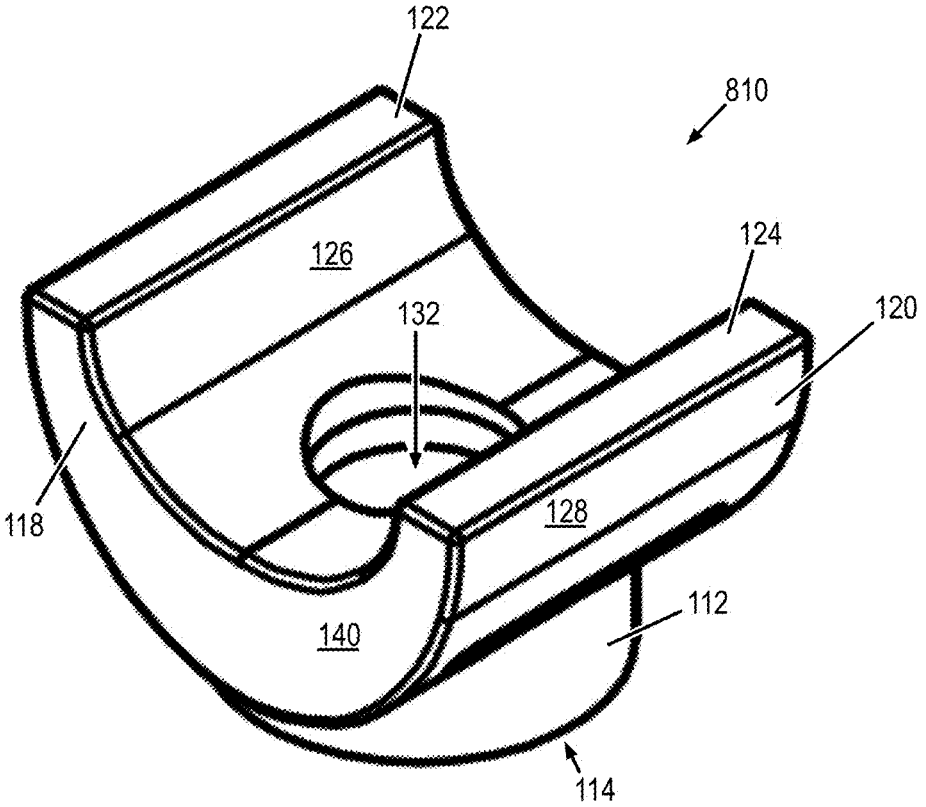
FIGS. 8 and 9 depict another example elastomeric mount portion.
Figure 9:
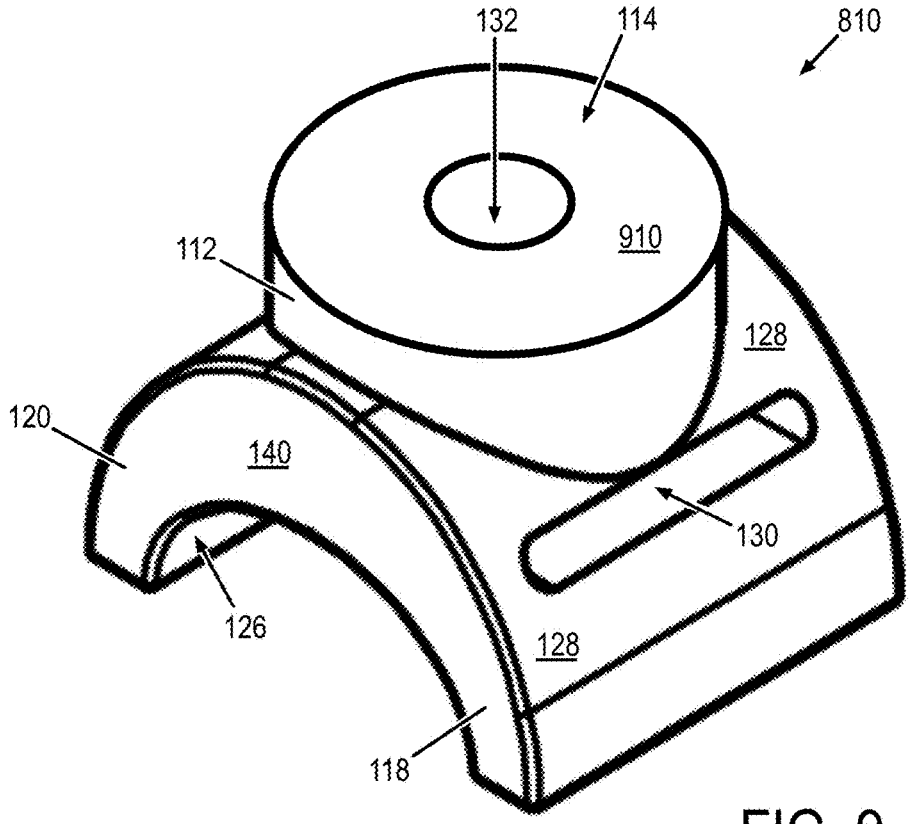

FIGS. 8 and 9 depict another example elastomeric mount portion 810. Elastomeric mount portion 810 includes many of the same features and components as previously described with reference to mount portion 110 of FIGS. 2-7 or with reference to mount portions 110*a* and 110*b* of FIG. 1. Accordingly, like reference numerals in FIGS. 8 and 9 refer to the same features and components as previously used with reference to FIGS. 1-7 and associated description.

In contrast to previously described mount portions 110, 110*a*, and 110*b*, mount portion 810 may be used on its own (i.e., without a second mount portion and fastener joining mount portion 810 to a second mount portion) to secure a flashlight to another object. In the example depicted in FIG. 8, interface surface 114 of mount portion 810 does not include teeth. And, as depicted in FIG. 9, for example, interface surface 114 of mount portion 810 provides a mounting surface 910 that interfaces with an object to which the mount portion 810 is to be secured. In this example, mounting surface 910 is a flat mounting surface (i.e., is normal to an axis of barrel 112).

In at least some implementations, mount portion 810 may be formed from the same or similar mold as previously described mount portions 110, 110*a*, and 110*b* in which teeth 116 may be removed by cutting barrel 112 across its section. This cutting operation may additionally provide the benefit of shortening an overall length of barrel 112, which brings the mounting arms 118 and 120 in closer to a distal end of the barrel defined by interface surface 114 and mounting surface 910. In other implementations, mount portion 810 may be formed from a different mold as compared to previously described mount portions 110, 110*a*, and 110*b*. In this implementation, bore 132 may be optionally omitted. In still further implementations, mounting surface 910 may include surface texture and/or interface surface 114 may include teeth 116. In some implementations, bore 132 may provide an advantage of allowing air to escape from or enter between mounting surface 910 and an object to which the mounting surface 910 interfaces, thereby reducing or eliminating trapped air and/or suction between interfacing surfaces.

FIG. 9 depicts mount portion 810 as including previously described channel 130. In the context of mount portion 810, channel 130 may accommodate two straps, such as previously described straps 160 and 162. A first of these two straps may be used to secure and retain a flashlight within a region defined by curved mounting surface 126. A second of these two straps may be used to secure and retain mounting surface 910 to another object. In at least some examples, this other object may take the form of a third strap (e.g., a shoulder strap of a backpack) or other suitable object.

Figure 11:
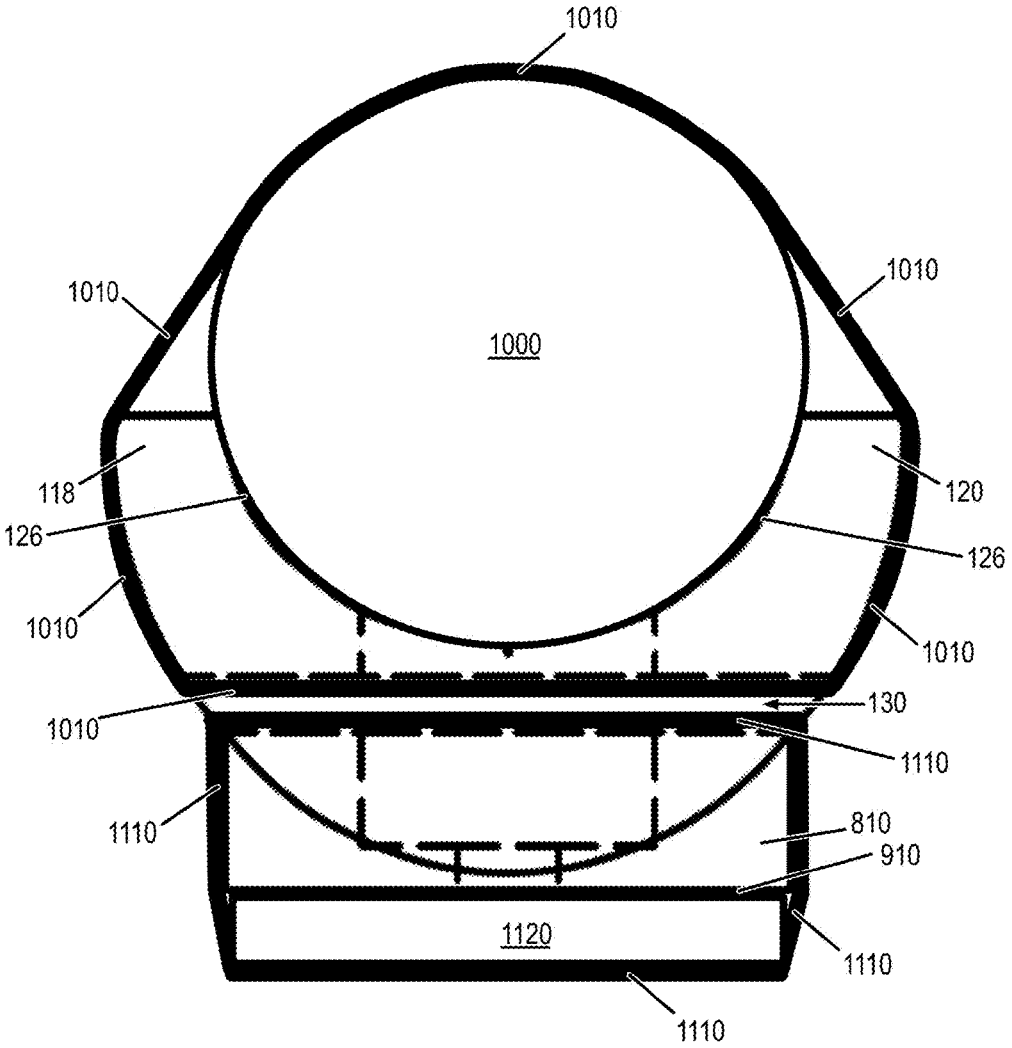
FIG. 11 depicts an example use-environment for the elastomeric mount portion of FIGS. 8 and 9.

FIG. 10 depicts an example use-environment for the elastomeric mount portion of FIGS. 2-7. In FIG. 10, strap 1010 passes through channel 130 of mount portion 110 and secures object 1000 to surfaces 126 of mounting arms 118 and 120. FIG. 11 depicts an example use-environment for the elastomeric mount portion of FIGS. 8 and 9. In FIG. 11, strap 1010 passes through channel 130 of mount portion 810 and secures object 1000 to surfaces 126 of mounting arms 118 and 120. Additionally, strap 1110 passes through channel 130 of mount portion 810 and secures object 1120 to surface 910. In these examples, object 1000 may refer to a flashlight, a mounting support, or other suitable object, and object 1120 of FIG. 11 may refer to another strap or other suitable object to which the mount portion is secured.

Figure 12:
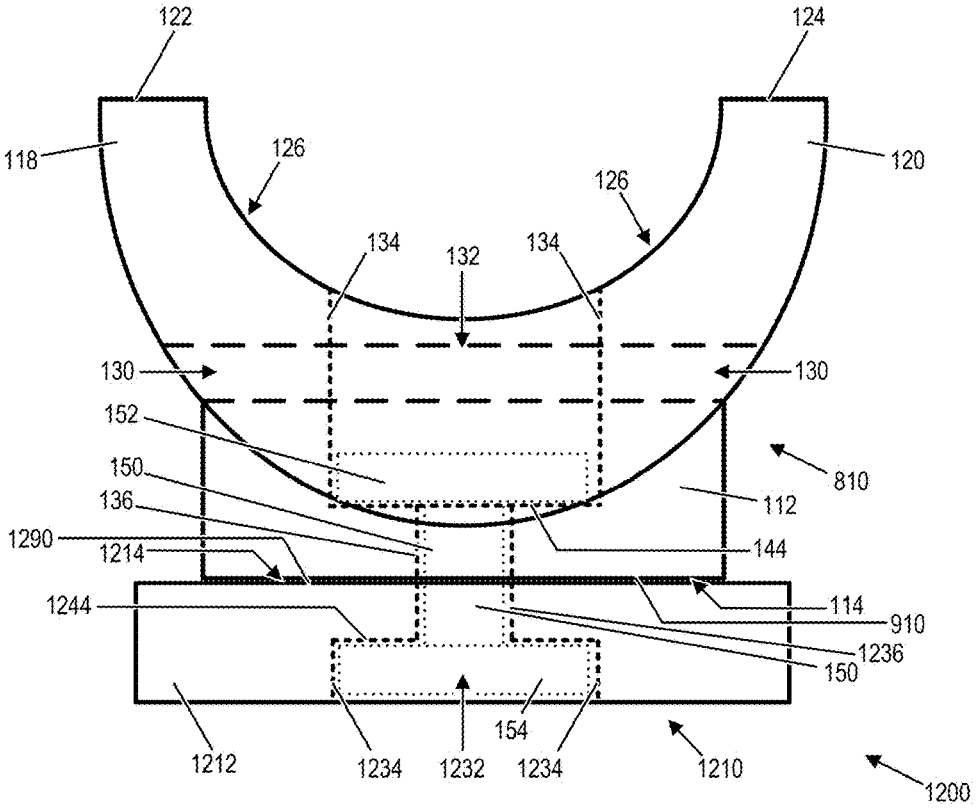
FIG. 12 depicts an example mounting system.

FIG. 12 depicts an example mounting system 1200. Elastomeric mount system 1200 may include any of the previously described elastomeric mount portions disclosed herein. As a non-limiting example, mounting system 1200 includes elastomeric mount portion 810 of FIGS. 8 and 9. As previously described, an elastomeric mount portion may include a barrel 112 having a first bore 130 formed therein along a longitudinal axis of the barrel and a rim at a first end of the barrel that forms a first interface surface 114. Elastomeric mount portion 810 further includes a pair of mounting arms 118, 120 that project outward from a second end of the barrel that collectively form an arc that defines a curved mounting surface 126 along an interior of the arc for mounting a first object. In at least some implementations, the pair of mounting arms each form a tapering arc that tapers from a base of that mounting arm that joins with the barrel to a distal end of that mounting arm. However, the pair of mounting arms may take other suitable forms, including non-tapered profiles.

Elastomeric mount portion 810 may have a channel 130 formed in the pair of mounting arms or the barrel that passes through the elastomeric mount portion, as previously described. A strap, such as previously described strap 160 (not depicted in FIG. 12), may pass through the channel to secure the first object to the curved mounting surface 126. Channel 130 may pass through a base of the pair of mounting arms (or the barrel) along an orthogonal axis to the longitudinal axis of the barrel, as previously described with reference to FIGS. 1-11, for example. As also previously described, the strap may include at least one of: hook and loop fasteners along respective portions of the strap to secure the strap around the first object; a releasable clip having two clip portions at respective positions along the strap to secure the strap around the first object; a buckle to secure the strap around the first object.

As further depicted in FIG. 12, for example, interface surface 114 of mount portion 810 provides a mounting surface 910 that interfaces with a second object 1210 to which the mount portion 810 is to be secured. In this example, mounting surface 910 is a flat mounting surface (i.e., is normal to an axis of barrel 112. Mounting system 1200 further includes a fastener for securing the elastomeric mount portion to second object 1210. As previously described, shaft 150 in combination with flanged portions 152 and 154 may be referred to collectively as a fastener or a fastening system. Shaft 150 passes through the first bore 132 along the longitudinal axis and projects outward from first interface surface 114 of barrel 112.

In at least some implementations, barrel 112 of the elastomeric mount portion includes a narrowing region of the first bore 130 that forms an opposing surface 144 to first interface surface 114 of the barrel. The fastener may further include a first flanged portion 152 that interfaces with opposing surface 144 of the barrel to oppose withdraw of the fastener through the first bore at the first end of the barrel. Elastomeric mount portion 810 may be rotatable relative to second object 1210 about shaft 150 of the fastener.

Mounting system 1200 may further include or otherwise incorporate the second object 1210. Second object 1210 includes a body portion 1212 having a second interface surface 1214 that is sized to at least accommodate first interface surface 114 of barrel 112. Body portion 1212 further include an opening 1232 (e.g., a bore) formed within second interface surface 1214 to receive shaft 150 of the fastener. Opening 1232, in the form of a bore, may include a first bore segment 1236, and optionally a second bore segment 1234. First bore segment 1236 is narrower than second bore segment 1234, in this example. Second bore segment 1234 may be omitted in some implementations.

In at least some implementations, the fastener includes a bolt and the shaft is a threaded shaft. Opening 1232 formed in body portion 1212 of second object 1210 may be a threaded opening that corresponds to the threaded shaft. For example, opening 1232 may take the form of a tapped opening or bore formed in body portion 1212. As another example, first flanged portion 152 includes one of a head of the bolt or a threaded nut, and second flanged portion 154 includes the other of the head of the bolt or the threaded nut. For example, second flanged portion 154 of the fastener may take the form of a threaded nut that is embedded and/or press fit into body portion 1212, which accommodates the threaded shaft and resists rotation of the threaded nut relative to the body portion. Alternatively or additionally, first flanged portion 152 may take the form of a threaded nut that is embedded and/or press fit into bore 132 of barrel 112. First flanged portion 152 of the fastener may be recessed within the curved mounting surface 126, in at least some implementations. Second flanged portion 154 of the fastener interfaces with an opposite side (e.g., an opposing surface 1244) of body portion 1212 from second interface surface 1214 to secure the second interface surface of second object 1210 to the first interface surface 114 of the elastomeric mount portion.

Elastomeric mount portion 810 may be secured to second object 1210 by the fastener compressing the barrel of the first elastomeric mount portion onto the body portion of the second object along the longitudinal axis. As an example, the fastener includes a rivet and shaft 150 may be a post of the rivet. Here, for example, first flanged portion 152 includes one of a head or a tail of the rivet, and second flanged portion 154 includes the other of the head or the tail of the rivet. In this implementation, shaft 150 of the rivet may be sized to compress barrel 112 onto body portion 1212 of second object 1210 within a predefined range of compression force. This compression force or range thereof may be experimentally determined to correspond to a sufficient resistance to rotation between mount portion 810 and second object 1210 for a given use, while also enabling a human of typical strength to overcome this resistance to rotation to adjust a relative positioning between mount portion 810 and second object 1210.

It should be understood that second object 1210 is depicted in FIG. 12 in schematic form. Second object 1210 may take various forms, depending on implementation. In at least some implementations, second object 1210 may include an accessory selected from the group comprising: a bottle cage (e.g., a water bottle cage for a bicycle); a mobile computing device mount; a lighting device (e.g., a flashlight or blinking light for a bicycle); a camera mount, as non-limiting examples. Within FIG. 12, the accessory may extend or otherwise be located on an opposite side of body portion 1212 from elastomeric mount portion 810, as a non-limiting example. In each of these or other examples disclosed herein, the first object secured to mounting surface 126 may take the form of a post, handlebar, beam, pipe, or other structural member, as non-limiting examples. However, the first and second objects may take other suitable forms.

In the example depicted in FIG. 12, first interface surface 114 and second interface surface 1214 are each substantially planar. Mounting surface 910 of first interface surface 114 and mounting surface 1290 of second interface surface 1214 may be smooth in at least some implementations. However, in another implementation, one or both of first interface surface 114 and/or second interface surface 1214 may include surface texture via their respective mounting surfaces 910, 1290. For example, first interface surface 114 may include a first set of teeth that are continuous along the rim of the barrel, as previously described with reference to teeth 116. Second interface surface 1214 may include a second set of teeth that are continuous along a circular shape (or other suitable configuration) that corresponds to the rim of barrel 112 to engage with the first set of teeth of first interface surface 114, again as previously described with reference to teeth 116, as a non-limiting example.

As previously described, elastomeric mount portion 810 or other elastomeric mount portion disclosed herein may be formed from or include silicone rubber, as a non-limiting example. However, other suitable elastomeric materials may be used. 21. The elastomeric mount portion may be formed from a unitary piece of elastomeric material, in at least some implementations. Body portion 1212 of second object 1210 may be formed from a non-elastomeric material, such as a non-elastomeric plastic, metal, wood, stone, ceramic, etc., among other suitable materials. The fastener or shaft 150 of the fastener may be a non-elastomeric shaft that is formed from a non-elastomeric material, such as a non-elastomeric plastic, metal, etc., among other suitable materials. However, in at least some implementations, shaft 150 may be formed from an elastomeric material, such as described herein with respect to the elastomeric mount portions.

While the various mount portions are described herein with respect to a flashlight, it will be understood that these various mount portions may be used outside of the flashlight context to secure any object to another object. Typically, curved mounting surface 126 is suitable for securing and interfacing with rounded and/or barrel-shaped objects. However, deformation of mounting arms 118 and 120 (enabled by the elastomeric material) may enable the various mount portions described herein to accommodate non-rounded or non-barrel-shaped objects.

The elastomeric components described herein may be formed from any suitable elastomeric material. As a non-limiting example, include this elastomeric material may include or consist of silicone rubber with a hardness of shore 70A. However, other suitable elastomeric materials may be used or included. Non-limiting examples of other suitable elastomeric materials include Nitrile (Buna-N) Rubber, natural rubber (e.g., including Polyisoprene), EPDM rubber, Viton, and other forms of silicone rubber or combinations of these and/or other materials.

It will be understood that the embodiments, and implementations described herein are exemplary in nature, and that these specific examples are not to be considered in a limiting sense, because numerous variations are possible. The subject matter of the present disclosure includes all novel and nonobvious combinations and sub-combinations of the various configurations, features, and/or properties disclosed herein, as well as any and all equivalents thereof.

The invention claimed is:

1. A mounting system, comprising:

an elastomeric mount portion including:

a barrel having a first bore formed therein along a longitudinal axis of the barrel and a rim at a first end of the barrel that forms a first interface surface, and a pair of mounting arms that project outward from a second end of the barrel that collectively form an arc that defines a curved mounting surface along an interior of the arc for mounting a first object, wherein a channel is formed in the pair of mounting arms or the barrel that passes through the elastomeric mount portion;

a fastener for securing the elastomeric mount portion to a second object, the fastener including a shaft that passes through the first bore along the longitudinal axis and projects outward from the first interface surface of the barrel; and a strap that passes through the channel to secure the first object to the curved mounting surface.

2. The mounting system of claim 1, wherein the barrel of the elastomeric mount portion includes a narrowing region of the first bore that forms an opposing surface to the first interface surface of the barrel; and wherein the fastener further includes a first flanged portion that interfaces with the opposing surface of the barrel to oppose withdraw of the fastener through the first bore at the first end of the barrel.

3. The mounting system of claim 2, further comprising the second object, wherein the second object includes a body portion having a second interface surface that is sized to at least accommodate the first interface surface of the barrel and an opening formed within the second interface surface to receive the shaft of the fastener.

4. The mounting system of claim 3, wherein the shaft of the fastener is a threaded shaft; and wherein the opening formed in the body portion of the second object is a threaded opening that corresponds to the threaded shaft.

5. The mounting system of claim 3, wherein a second flanged portion of the fastener interfaces with an opposite side of the body portion from the second interface surface to secure the second interface surface of the second object to the first interface surface of the elastomeric mount portion.

6. The mounting system of claim 5, wherein the fastener includes a bolt and wherein the shaft is a threaded shaft; and wherein the first flanged portion includes one of a head of the bolt or a threaded nut, and the second flanged portion includes the other of the head of the bolt or the threaded nut.

7. The mounting system of claim 5, wherein the fastener includes a rivet and wherein the shaft is a post of the rivet; and wherein the first flanged portion includes one of a head or a tail of the rivet, and the second flanged portion includes the other of the head or the tail of the rivet.

8. The mounting system of claim 7, wherein the shaft of the rivet is sized to compress the barrel onto the body portion of the second object within a predefined range of compression force.

9. The mounting system of claim 3, wherein the elastomeric mount portion is secured to the second object by the fastener compressing the barrel of the first elastomeric mount portion onto the body portion of the second object along the longitudinal axis.

10. The mounting system of claim 3, wherein the second object further includes an accessory selected from the group comprising:

a bottle cage; a mobile computing device mount; a lighting device; a camera mount.

11. The mounting system of claim 3, wherein the first interface surface and the second interface surface are each substantially planar.

12. The mounting system of claim 3, wherein the body portion of the second object is formed from a non-elastomeric material.

13. The mounting system of claim 1, wherein the elastomeric mount portion is rotatable relative to the second object about the shaft of the fastener.

14. The mounting system of claim 1, wherein the shaft of the fastener is a non-elastomeric shaft.

15. The mounting system of claim 1, wherein the channel passes through a base of the pair of mounting arms along an orthogonal axis to the longitudinal axis of the barrel.

16. The mounting system of claim 1, wherein the strap includes at least one of:

hook and loop fasteners along respective portions of the strap to secure the strap around the first object;

a releasable clip having two clip portions at respective positions along the strap to secure the strap around the first object;

a buckle to secure the strap around the first object.

17. The mounting system of claim 1, wherein the pair of mounting arms each form a tapering arc that tapers from a base of that mounting arm that joins with the barrel to a distal end of that mounting arm.

18. The mounting system of claim 1, wherein the elastomeric mount portion is formed from or includes silicone rubber.

19. The mounting system of claim 1, wherein the elastomeric mount portion is formed from a unitary piece of elastomeric material.

20. The mounting system of claim 1, wherein the first flanged portion of the fastener is recessed within the curved mounting surface.

* * * * *